US008511600B2

(12) United States Patent
Formon et al.

(10) Patent No.: US 8,511,600 B2
(45) Date of Patent: Aug. 20, 2013

(54) DISPENSER THAT AUTOMATICALLY TRANSFERS ROLLS OF ABSORBENT MATERIAL, METHOD OF RELOADING SAME, AND ROLLS OF ABSORBENT MATERIAL FOR USE IN SAME

(75) Inventors: John S. Formon, Appleton, WI (US); Russell G. Wieser, Appleton, WI (US)

(73) Assignee: SCA Tissue North America LLC, Neenah, WI (US)

( * ) Notice: Subject to any disclaimer, the term of this patent is extended or adjusted under 35 U.S.C. 154(b) by 102 days.

(21) Appl. No.: 13/149,253

(22) Filed: May 31, 2011

(65) Prior Publication Data

US 2011/0226883 A1 Sep. 22, 2011

Related U.S. Application Data

(63) Continuation of application No. 11/541,666, filed on Oct. 3, 2006, now Pat. No. 7,967,235.

(51) Int. Cl.
*B65H 16/04* (2006.01)

(52) U.S. Cl.
USPC ..... 242/597.6; 242/599.4

(58) Field of Classification Search
USPC ..... 242/596.7, 597, 597.5, 597.6, 613.5, 242/599, 599.4
See application file for complete search history.

(56) References Cited

U.S. PATENT DOCUMENTS

| | | | | |
|---|---|---|---|---|
| 1,618,342 | A * | 2/1927 | Kirkman | 242/597.5 |
| 2,236,178 | A * | 3/1941 | Kennedy | 242/597.6 |
| 2,299,301 | A | 10/1942 | Britt | |
| 3,132,817 | A | 5/1964 | Rawson | |
| 3,387,902 | A | 6/1968 | Perrin | |
| 3,627,220 | A | 12/1971 | Vogel | |
| 3,677,485 | A | 7/1972 | Berg | |
| 3,840,194 | A | 10/1974 | Vetter | |
| 4,008,860 | A * | 2/1977 | Tanaka | 242/597.6 |
| 4,372,500 | A | 2/1983 | Saraisky | |
| 4,422,584 | A | 12/1983 | Dashnier | |
| 4,856,724 | A | 8/1989 | Jespersen | |
| 4,977,930 | A | 12/1990 | Munk | |
| 5,125,586 | A | 6/1992 | Whitethorn | |
| 5,288,032 | A | 2/1994 | Boone | |
| 5,322,234 | A | 6/1994 | Robert | |
| 5,513,820 | A | 5/1996 | Meyer | |
| 5,690,299 | A | 11/1997 | Perrin | |
| 5,873,542 | A | 2/1999 | Perrin | |
| 6,752,349 | B2 | 6/2004 | Moody | |
| 7,967,235 | B2 * | 6/2011 | Forman et al. | 242/560 |
| 2003/0146337 | A1 | 8/2003 | Moody | |

* cited by examiner

*Primary Examiner* — William A Rivera

(74) *Attorney, Agent, or Firm* — Buchanan Ingersoll & Rooney PC

(57) ABSTRACT

A two-roll toilet paper dispenser automatically transfers a new roll into dispensing position once the previous roll is spent or nearly spent. A spring-loaded plate senses the decreasing diameter of the first roll, and once it reaches a predetermined minimum, actuates a linkage that permits a mandrel carrying the two rolls to drop down within the dispenser body and position the second roll for dispensing. The mandrel and track structure permits reloading the dispenser without removing the mandrel. The rolls of toilet paper have adapter plugs in one end only, to ensure that the rolls are placed in the correct orientation within the dispenser.

20 Claims, 10 Drawing Sheets

DISPENSER THAT AUTOMATICALLY TRANSFERS ROLLS OF ABSORBENT MATERIAL, METHOD OF RELOADING SAME, AND ROLLS OF ABSORBENT MATERIAL FOR USE IN SAME

CROSS REFERENCE TO RELATED APPLICATIONS

This application is a continuation of application Ser. No. 11/541,666 filed on Oct. 3, 2006. The entire contents of the above-identified application are hereby incorporated by reference.

BACKGROUND OF THE INVENTION

1. Field of the Invention

The invention relates to an apparatus for automatically transferring rolls of absorbent material such as toilet paper or other wiping materials, as well as a method for reloading such an apparatus, and rolls of absorbent material specially adapted for use the apparatus.

2. Description of Related Art

In conventional multi-roll sheet dispensing apparatus, material from a first roll of absorbent material is incrementally dispensed through a dispensing opening in a housing. In some dispensers, as long as there is material on the first roll, a lever remains in position to prevent a second roll from falling down by gravity.

U.S. Pat. No. 5,288,032 to Boone et al. is a dispenser of that type. However, in such dispensers, each roll of absorbent material requires two core plugs, which may lead to core plug insertion issues and which also permits a roll of toilet paper to be positioned in either of two orientations, such that the sheets could come from behind and under the roll, instead of the preferred over the top orientation. In addition, there are sometimes retention problems with the spent cores in that the cores are prone to fall out of the dispenser and onto the floor.

Several attempts have been made to address the above-noted problems including U.S. Pat. No. 5,873,542 to Perrin et al. and a more recent attempt shown in U.S. Pat. No. 6,752,349 to Moody et al.

The device of Perrin attempts to solve the issue of the spent cores by using a mandrel. However, the device of Perrin does not automatically transfer the second roll once the first roll runs out. Rather, a user must physically dislodge the mandrel from a stop portion to enable the mandrel to slide down so that the second roll can be accessed.

The device of Moody is complicated in that it requires not only a specialized latch dog assembly on the mandrel, but also removal of the entire mandrel from the dispenser in order to load a new roll.

SUMMARY OF THE INVENTION

An object of the invention is to overcome one or more of the above-described shortcomings of the prior art, or to alleviate one or more of those shortcomings of the prior art at least in part.

Another object of the invention is to have a relatively simple device for automatically transferring rolls of absorbent material that can be loaded and reloaded by a simple technique.

BRIEF DESCRIPTION OF THE DRAWINGS

The above and other objects and advantages of the invention will become apparent from the following detailed description of preferred embodiments thereof, given with reference to the accompanying drawing figures, in which.

DETAILED DESCRIPTION OF THE PREFERRED EMBODIMENTS

Figure 1:
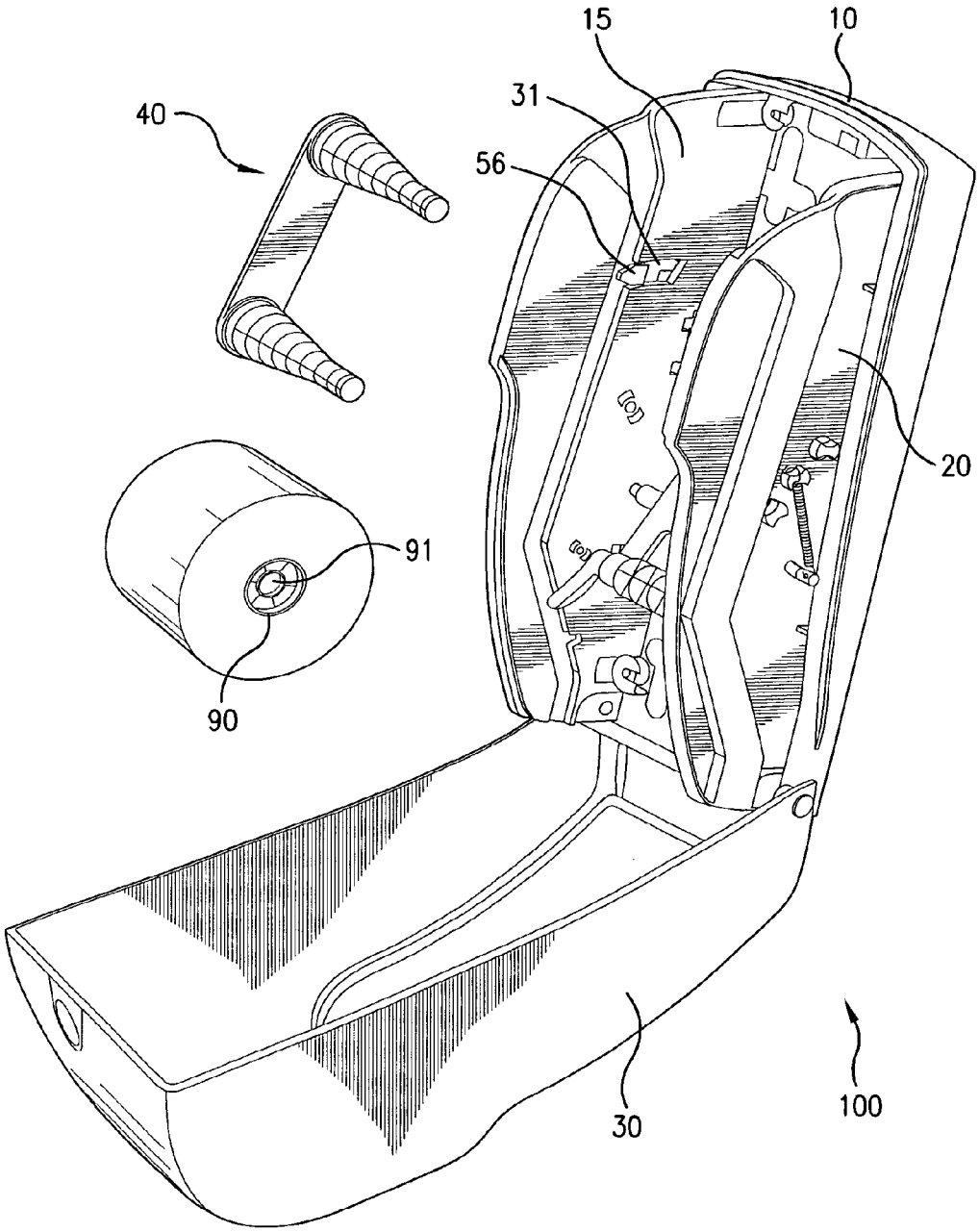
FIG. 1 is a perspective view of a first embodiment of a dispenser according to the invention in an open position.

FIG. 1 shows a dispensing device 100 for automatically transferring a second roll (see R2 in FIG. 4) of absorbent material to be dispensed when a first roll R1 is spent or substantially spent.

Figure 2:
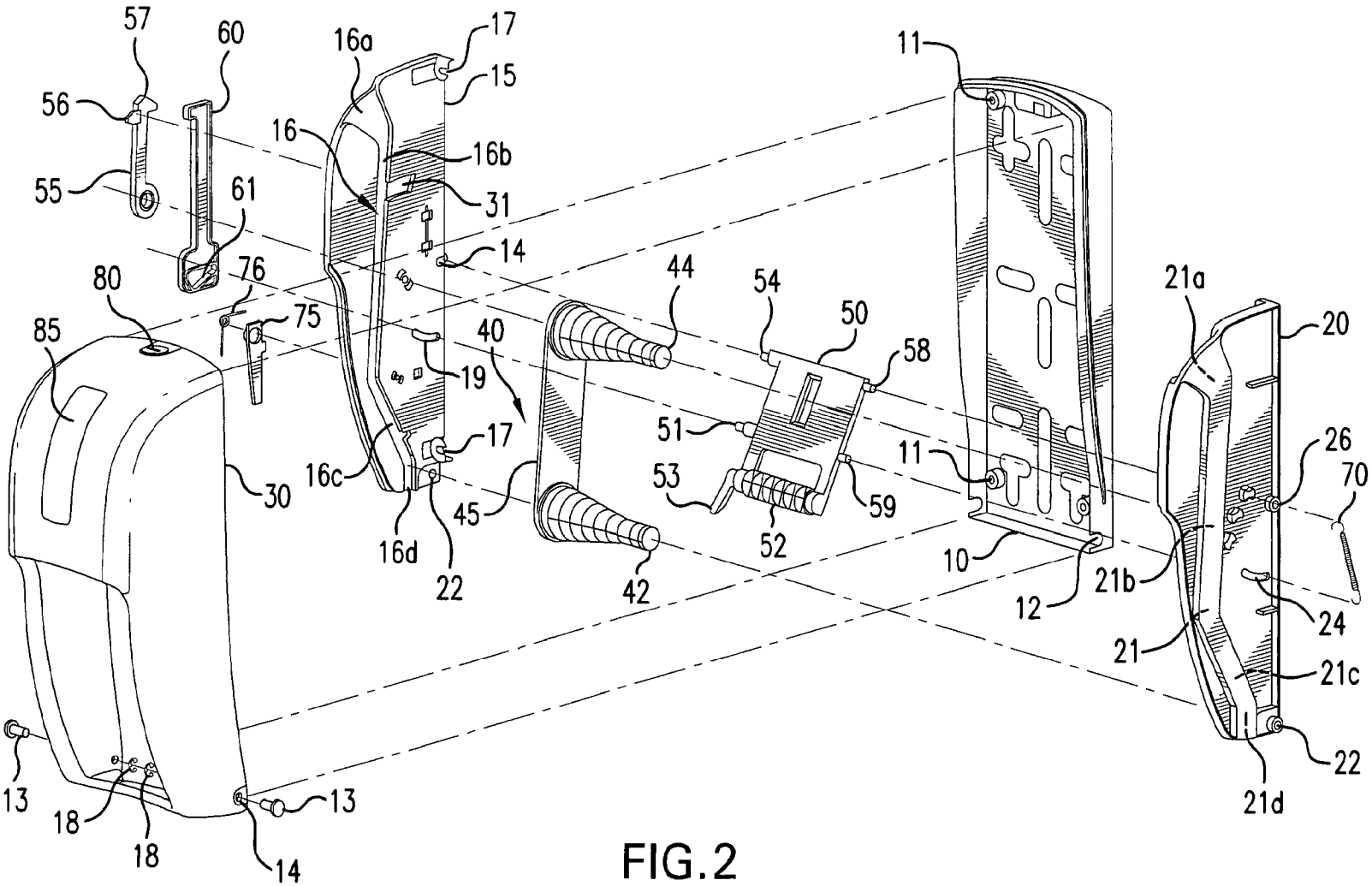
FIG. 2 is an exploded view of the dispenser according to FIG. 1.

With respect to FIGS. 1 and 2, the dispensing device 100 includes a main body having a back portion 10 and first and second side portions 15, 20. A cover 30 is pivotally mounted to the first and second side portions 15, 20 using, for example, pins 13 and clips 18, with pins 13 passing through openings 14 in cover 30, then through slots 12 in back portion 10, and then through bores 22 in side portions 15, 20. However, any known manner of connecting two elements that pivot with respect to each other including, cotter pins, nut/bolt/washer combinations and any other element is contemplated by the present invention. As shown in FIG. 1, the side portions 15, 20 are nested within back portion 10, and secured for example by screws (not shown) passing through slots 17 on the side portions 15, 20 and threaded bores 11 on the back portion 10. The cover 30 is pivotal between an open loading position as seen in FIG. 1 and a closed dispensing position. The cover 30 may include a transparent portion 85 as shown in FIG. 2 so that a user can see whether there is a second roll of absorbent material in the dispenser 100 without opening the cover 30.

As shown in FIG. 2, each of the side portions 15, 20 includes a mandrel channel. Left-hand side portion 15 includes mandrel channel 16. Right-hand side portion 20 includes mandrel channel 21.

Figure 4:
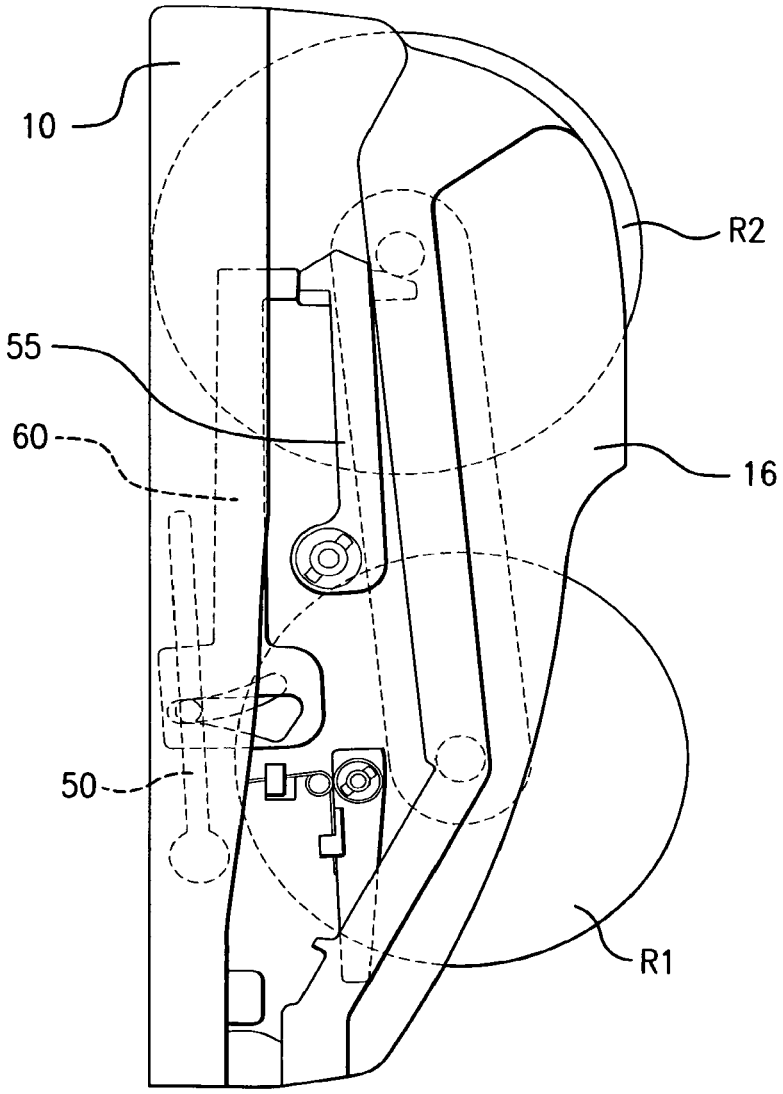
FIG. 4 is a side view with the cover removed for clarity showing an embodiment of the invention when the mandrel is in a first position.
Figure 6:
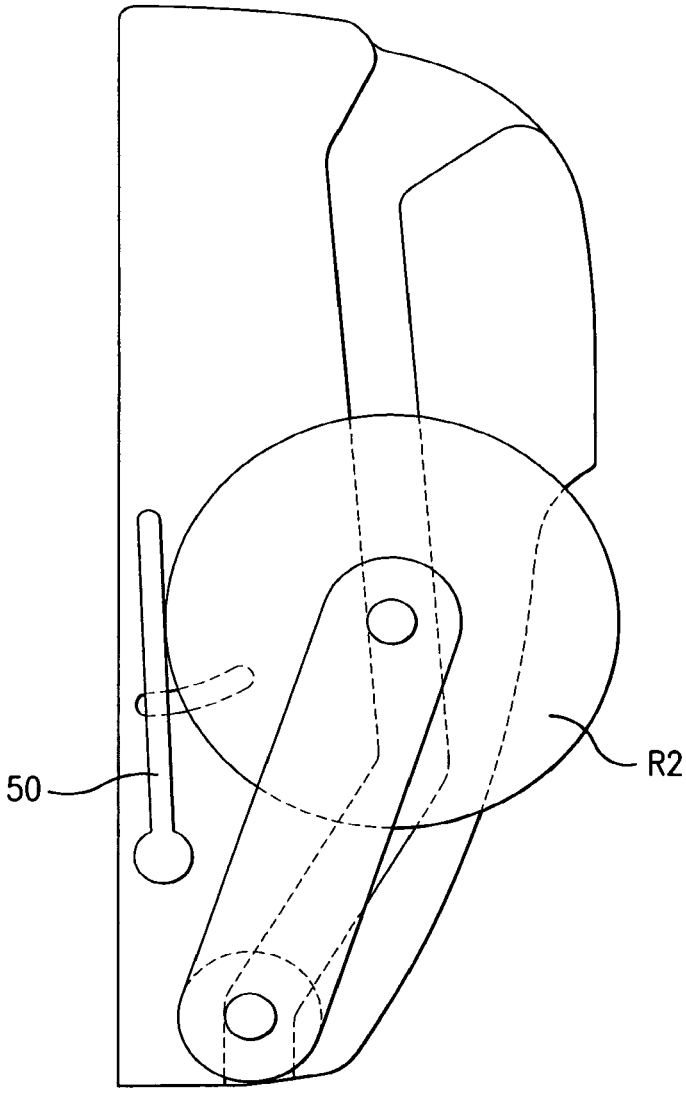
FIG. 6 is a sectional view showing an embodiment of the invention when the dispenser cover is closed and the mandrel is in a second position.
Figure 7:
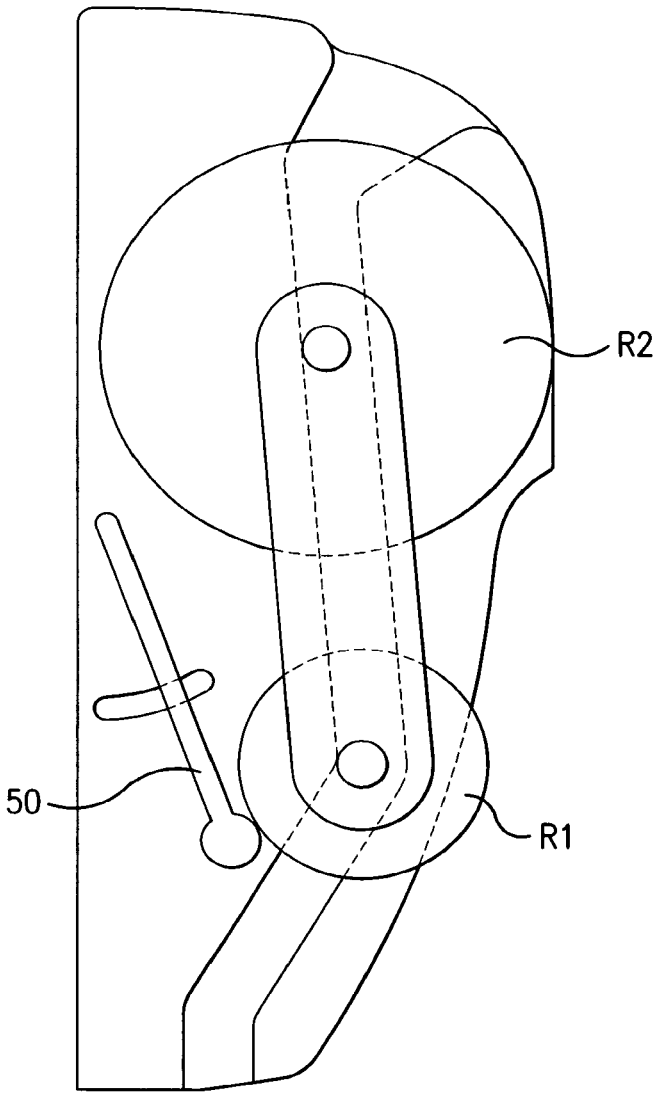
FIG. 7 is a sectional view showing the mandrel in the first position and the sensor plate in a second position.
Figure 8:
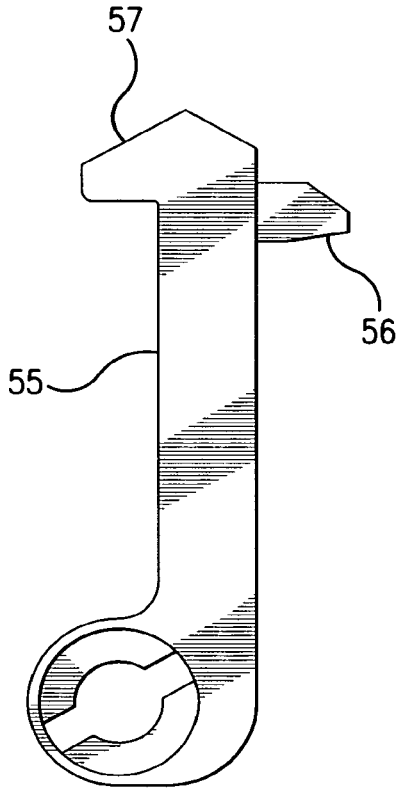
FIG. 8 is a side view of a transfer link according to an embodiment of the invention.

A support mandrel 40 is slidably positioned in the mandrel channels 16, 21. The support mandrel 40 has first and second roll holding elements 42, 44. The support mandrel 40 in use moves automatically between a first position for dispensing sheets of absorbent material from a first roll R1 of absorbent material contained on the first roll holding element 42 as shown in FIG. 4 and a second position for dispensing sheets of absorbent material from a second roll R2 of absorbent material contained on the second roll holding element 44 as shown in FIG. 6. As shown in FIG. 6, the first roll R1 of absorbent material is spent or substantially spent when the support mandrel 40 is in the second position.

Figure 3:
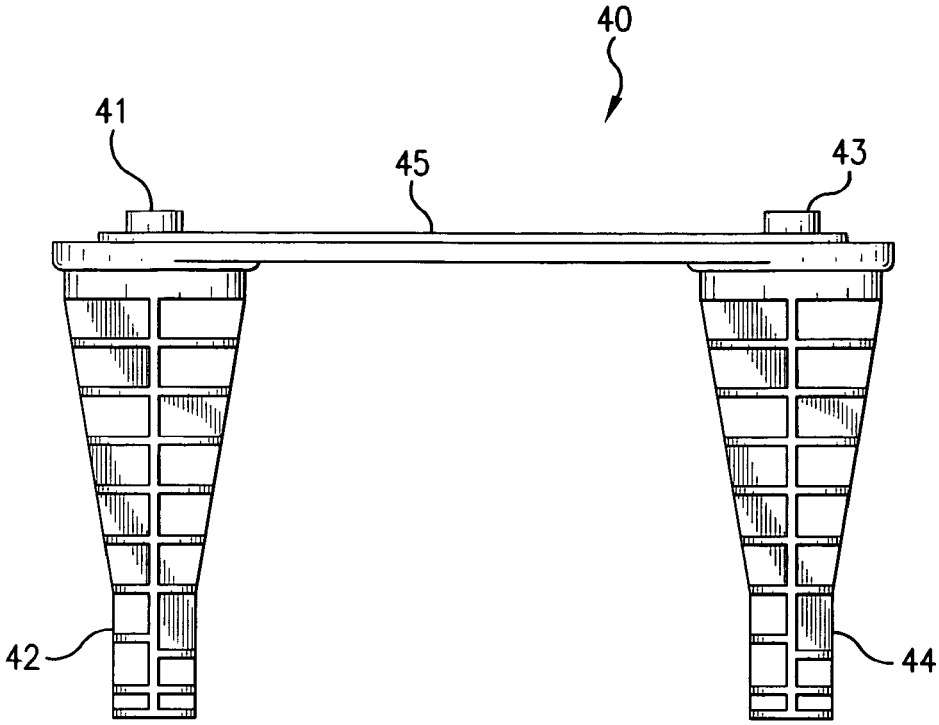
FIG. 3 is a top view of a support mandrel according to an embodiment of the invention.

In the embodiment of FIGS. 2 and 3, the support mandrel 40 includes a flange 45 having first and second opposing sides. Guide elements 41, 43 extend in a first direction from the first side of the flange 45 and have a first diameter. The roll support elements 42, 44 extend from the second side of the flange 45 in a second direction opposite the first direction. The roll support elements 42, 44 are each tapered from a proximal end to a free distal end. The diameter of the proximal end closely corresponds to the inner diameter of a roll of toilet paper, so as to hold the same rotatably but with as little play as possible. The distal ends have a diameter that is greater than the diameter of the guide elements 41, 43, but less than the diameter of the proximal ends. That difference in diameter between the distal ends and the guide elements, and the fact that channel 16 is narrower than channel 21, means that the mandrel can be inserted into the dispenser only in one orientation, i.e., in this embodiment, with the free distal ends pointing to the right as the dispenser is viewed from the front.

Each roll support element 42, 44 is preferably coaxial with a corresponding one of the guide elements 41, 43. The proximal end of the roll support elements 42, 44 is preferably non-rotatable.

As shown in FIG. 2, the dispenser also includes a sensor plate 50 that is disposed between side portions 15, 20 and pivotally mounted thereto via pins 54, 58 received in openings 14, 26. The sensor plate 50 is urged forwardly by a spring 70 that is connected at its upper end to a boss on the outer side of side portion 20, and at its lower end to a pin 59 that projects laterally from sensor plate 50 through an arcuate track 24 formed in side portion 20.

Sensor plate 50 bears via roller 52 against the outer periphery of a lower roll R1 of toilet paper. As the toilet paper is withdrawn from roll R1 by users, spring 70 urges the roller 52 to maintain in continuous contact with roll R1. Thus, as the toilet paper on roll R1 is consumed, the diameter of that roll steadily diminishes, and the plate 50 gradually pivots forwardly, causing pins 59 and 51 to travel forwardly in arcuate slots 24 and 19, respectively.

Pin 51 of sensor plate 50 projects through arcuate slot 19, and is received in the generally triangular opening 61 of a slide arm 60 (see FIGS. 2 and 4). Slide arm 60 is mounted for vertical sliding movement on the outer side of side portion 15, and even with the cover removed as in FIG. 4, most of the slide arm is in this embodiment concealed by the lateral parts of back portion 10.

Figure 5:
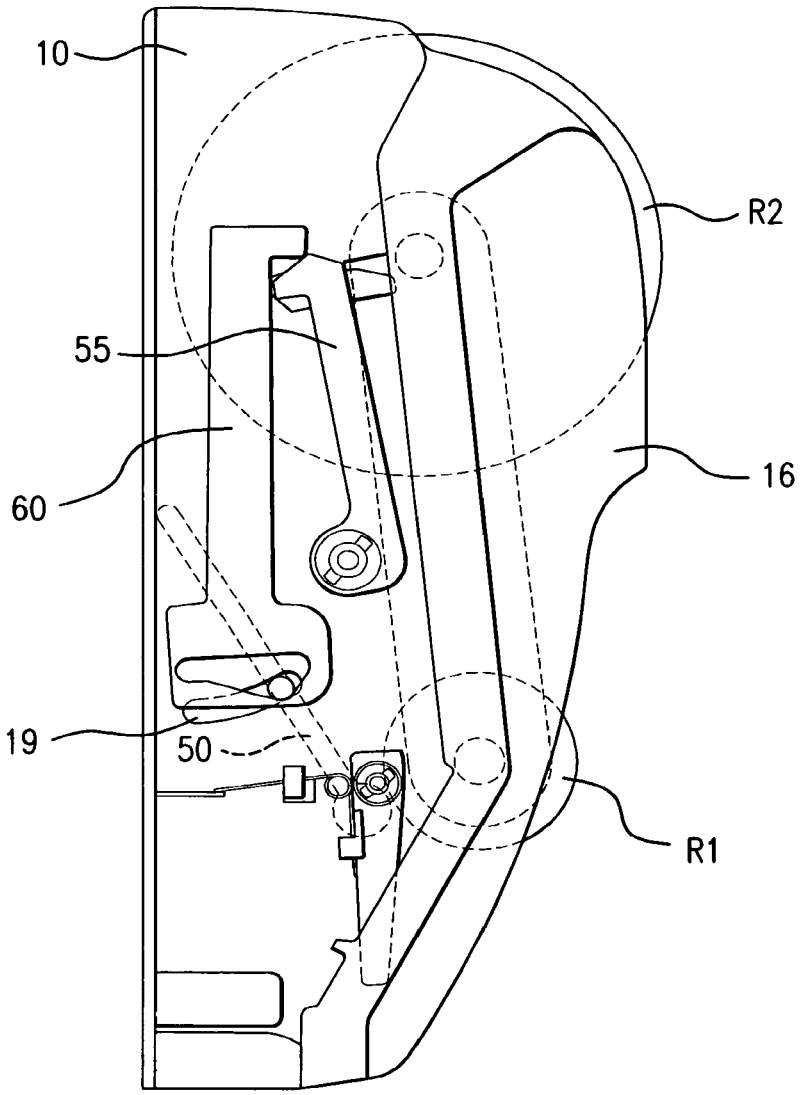
FIG. 5 is a side view similar to that of FIG. 4, when the mandrel has been freed to move to its second position.

Slide arm 60 coacts with a transfer link 55 that is pivotally mounted at its lower end to the outer side of side portion 15. Transfer link 55 includes an upper distal end that contacts the distal end of the slide arm. The upper distal end of transfer link 55 includes a projecting element 56 that passes through an opening 31 formed in side portion 15. Projecting element 56 is moveable from a position as shown in FIGS. 1 and 4 in which it blocks the channel 16 and forces mandrel 40 to stay in the position shown in FIG. 4, to a position as shown in FIG. 5 where transfer link has been pivoted counterclockwise relative top the position shown in FIG. 4, and projecting element is withdrawn from the channel to permit the mandrel to slide downwardly and position roll R2 for dispensing.

As noted above, as the diameter of roll R1 decreases with the withdrawal of toilet paper from the roll, pin 51 travels forwardly in arcuate slot 19. Because the distal end of pin 51 is also received in the opening 61 of slide arm 60, arm 60 is moved progressively vertically upwardly as pin 51 travels forwardly in slot 19. So long as the vertical front-facing surface of the upper end of slide arm 60 is contacting the vertical rear-facing surface of the upper end of transfer link 55, the transfer link 55 is prevented from pivoting counterclockwise, and the projection 56 is kept in the channel 16 through opening 31, thereby blocking the guide element 43 and preventing the mandrel from dropping down (FIG. 4).

However, once the lower roll R1 is empty or nearly empty (or, more generally, has reached a predetermined minimum diameter corresponding to a forward position of pin 51 in slot 19), the slide arm 60 has been raised sufficiently high so as to be free of the blocking contact with the upper end of transfer link 55. Then, the weight of upper roll R2 bearing on the inclined upper surface of projection 56 via guide element 43 causes transfer link 55 to pivot counterclockwise (relative to the vantage point of FIG. 4). The oppositely-inclined surface 57 of transfer link 55 on the outside of side portion 15 at this time coacts with slide arm 60 to raise the same to its maximum vertical position, with pin 51 resting in the bottom of triangular opening 61, as shown in FIG. 5.

The mandrel 40 bearing fresh upper roll R2 and spent or nearly spent lower roll R1 is then free to drop down to the position shown in FIG. 6, in which roll R2 is in dispensing position (albeit slightly higher than the dispensing position of roll R1 in FIG. 4), and in which the lower end of mandrel 40 is confined within the dispenser by cover 30 (channels 16, 21 being open at their upper and lower ends). As the full roll R2 drops down, it deflects the sensor plate 50 backwardly against the action of spring 70, as shown in FIG. 6, so that projection 56 returns to its blocking position inside channel 16. Although there is no mandrel part above projection 56 at this point, its blocking position prevent a user from pushing roll R2 upwardly into the dispenser housing and out of its dispensing position.

Even as the roll R2 is depleted, sensor plate 50 remains deflected rearwardly and projection 56 remains in the blocking position in channel 16, by virtue of the mandrel 40 in this dropped-drown position bearing against the lateral arm 53 provided on sensor plate 50

It is also preferred to include a mandrel channel brake 75 at a lower end of one of the mandrel channels (16 in the embodiment of FIGS. 2 and 4) that slows the movement of the support mandrel 40 between the first and second positions. The mandrel channel brake 75 may also serve to prevent the support mandrel from being pushed up into the cover 30. The mandrel channel brake 75 preferably includes a spring 76 urging the mandrel channel brake 75 into the mandrel channel 16 to slow the movement of the support mandrel 40.

The dispensing device 100 preferably includes a locking mechanism 80 connected to the cover 30 for locking the cover 30 to the back portion 10.

In a presently preferred embodiment, the mandrel channels 16, 21 and/or the guide elements 41, 43 may include motion control grease to control the rate of descent of the support mandrel 40 from the first position to the second position.

In a presently preferred embodiment, the mandrel channels 16, 21 are configured so that when the support mandrel 40 is in the second (dropped-down) position and when roll R2 is a full or substantially full roll, the support mandrel 40 is prevented from being removed from the dispenser even when the cover is in the open position.

As shown in FIG. 2, the mandrel channels 16, 21 are nearly mirror images of each other except that one channel 16 is thinner than the other mandrel channel 21 (and includes opening 31 for projection 56, as discussed above). Each mandrel channel 16, 21 include a wider portion 16*a*, 21*a* at a top thereof for insertion of the support mandrel 40. The mandrel channels 16, 21 also each have a first substantially vertical portion 16*b*, 21*b* adjacent the wider portion 16*a*, 21*a*, an angled portion 16*c*, 21*c* adjacent the first substantially vertical portion 16*b*, 21*b* that is angled toward the back portion 10 and a second substantially vertical portion 16*d*, 21*d* at a bottom of the mandrel channels.

When the support mandrel is in the second position, guide element 43 and the distal end of roll support element 44 of the support mandrel 40 are at the junction between the first substantially vertical portion 16*b*, 21*b* and the first angled portion 16*c*, 21*c*. Due to the substantial remaining thickness of the roll R2 and because of the angled portions 16*c*, 21*c*, sensor plate 50 prevents the support mandrel 40 from being removed from the dispenser even when the cover 30 is open. Once sufficient absorbent material has been removed from the second roll R2, the support mandrel 40 can be withdrawn from the open dispenser at the bottoms of the second substantially vertical portions 16*d*, 21*d*.

Preferably, prior to the material on roll R2 being completely or substantially completely removed from the second roll R2, maintenance personnel will see through window 85 that no upper roll is present, and a new roll of absorbent material will be placed on the empty roll holding element 42. Roll holding element 42 bearing a newly-replaced fresh roll R1 may then be flipped upwardly using elements 43 and 44 still resident in channels 16 and 21, respectively, as a fulcrum, this maneuver involving both pivoting and translation of these elements. The wider portion 16*a*, 21*a* facilitate introduction of the guide element 41 and the roll holding element 42 bearing fresh roll R1 into the mandrel channels 16, 21, and this operation can be performed easily and without ever removing the support mandrel 40 from the dispensing device 100.

Figure 9:
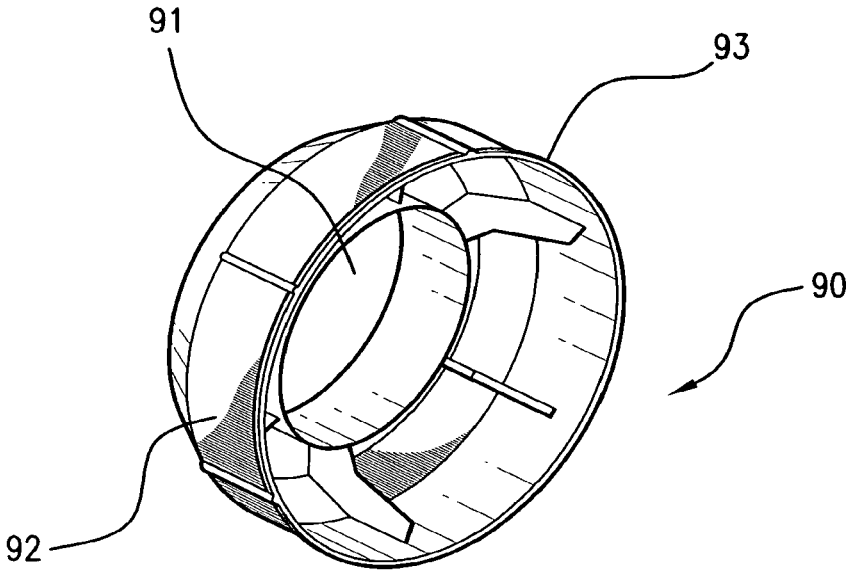
FIG. 9 is a perspective view of the core plug 90 of FIG. 1.

As noted previously, roll holding elements 42, 44 are wider at their base and narrower at their free distal ends. The rolls of absorbent material to be used in the dispenser of the invention preferably include a core plug 90, as shown in FIGS. 1 and 9. The core plug 90 fits snugly into a roll of absorbent material, and preferably has an outer diameter that will be a friction fit via surface 92 inside a standard cardboard toilet paper core. Each of the first and second roll holding elements 42, 44 has a distal end whose diameter preferably corresponds to the diameter of a hole 91 in the core plug 90, in that the core plug fits over the distal end of the roll holding elements and is rotatable relative thereto, but with as little play as possible.

In operation, as seen in FIGS. 4 and 5, the absorbent material is removed from the first roll R1 until this roll is depleted or substantially depleted. The sensor plate 50 detects that the roll R1 is depleted and then based on the position of the slide arm, as set forth above, the weight of the second roll R2 causes the transfer link to be shifted out of the guide groove 16, enabling the mandrel 40 with the second roll thereon to drop under the influence of gravity. The mandrel moves from the first position as seen in FIG. 4 to the second position as seen in FIG. 5.

Hopefully not long thereafter, a maintenance person will notice that the first roll R1 is spent and must be replaced with a new roll. To replace the roll, the maintenance person opens the cover 30 of the dispensing device 100. The maintenance person then places a new roll of absorbent material on an end of the support mandrel 40. In the shown embodiment, the new roll is placed on roll holding element 44.

However, as would be recognized by one of ordinary skill in the art, the support mandrel is symmetrical about a horizontal axis and the new roll would be placed on the appropriate end that needs replacement. The maintenance person would then pivot the support mandrel 40 about an axis of the roll holding element 42, while the support mandrel 40 is contained within the dispensing device 100. Of course, if the second roll were also sufficiently depleted, the maintenance person could remove the support mandrel 40 from the mandrel channels 16, 21 and add new rolls to both the first and second roll holding elements 42, 44.

If the maintenance person were only replacing a single roll, after pivoting the support mandrel 40, the maintenance person would insert the roll holding element 44 of the support mandrel 40 into the mandrel channels 16, 21 at the wider portion 16*a*, 21*a* at the top of the dispensing device 100. The maintenance person would then close the cover 30. Of course, if the cover 30 were to include a locking mechanism 80, the maintenance person would lock and unlock the locking mechanism 80 at the appropriate times in the loading process.

In the presently preferred embodiment, the new rolls of absorbent material each come pre-packaged with a core plug 90 in only one end to assist in easy installation by making the roll insertable in only one orientation.

Another aspect of the present invention is therefore a roll of absorbent material as depicted for example in FIG. 1 and as described above. The inventive roll of absorbent material is characterized by having openings of distinctly different diameters at its respective sides. In a preferred embodiment, the inventive roll of absorbent material is an otherwise conventional roll of toilet paper having a cardboard core, into one end of which is inserted a core plug 90 as described above. Core plug 90 is preferably an injection molded plastic component, whose outer diameter 92 is a snug fit inside the cardboard core. The core plug preferably also includes a small radially outwardly projecting flange 93 whose outer diameter is greater than the inner diameter of the cardboard core, to prevent the plug from being inserted too deeply. The roll of absorbent material according to the invention includes such a core plug in one end only, to oblige a maintenance person to place the roll into the dispenser in the correct orientation (over the top dispensing, as described above).

Figure 10:
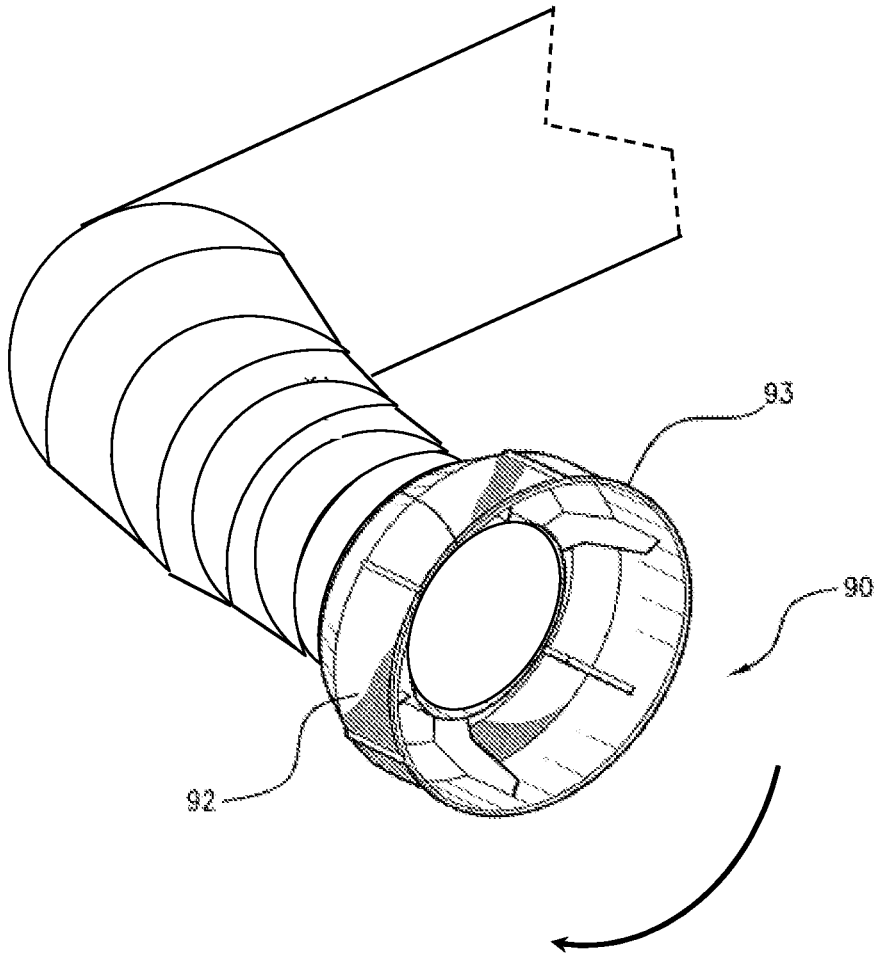
FIG. 10 shows the spinning of the core plug on the free distal end of the roll support element.

Core plug 90 has a circular central opening 91, which permits mandrel 40 to be made in one piece, because the plugs 90 can spin on the free ends of the roll holding elements 42 and 44 (See FIG. 10). Alternatively, the central opening 91 may be formed in any desired non-circular shape. In this case, the distal ends of roll holding elements 42 and 44 are made in a complementary non circular shape, and the roll holding elements are fashioned so as to be rotatable relative to the body of mandrel 40, or alternatively, the non-circular distal ends of roll holding elements 42 and 42 are made rotatable relative to the remainder of roll holding elements 42 and 44.

The invention has been described in detail with respect to presently preferred embodiments. However, it will be apparent to those of skill in the art that changes or modifications may be made without departing from the spirit of the invention. The invention should not be limited by the disclosed embodiments and rather should be defined by the appended claims.

What is claimed is:

1. A roll of absorbent sheet material mounted on a support mandrel, comprising:

a length of absorbent sheet material wound on a cylindrical core, the cylindrical core comprising openings of a first inner diameter at each end;

a core plug present in said cylindrical core at one end only, the core plug having a circular opening with a diameter substantially less than that of said first inner diameter, and the support mandrel having a roll support element that is tapered from a proximal end to a free distal end of the roll support element, the cylindrical core configured to spin on at least the proximal end of the roll support element, the core plug and opening being configured to spin on the free distal end of the roll support element.

2. The roll of absorbent sheet material according to claim 1, wherein the length of absorbent sheet material is toilet paper, the cylindrical core is made of cardboard, the core plug is made of injection-molded plastic.

3. The roll of absorbent sheet material according to claim 1, wherein the core plug has a circular central opening.

4. The roll of absorbent material according to claim 1, wherein the core plug comprises a radially outwardly projecting flange having an outer diameter greater than said first inner diameter of the cylindrical core.

5. The roll of absorbent material according to claim 1, wherein a diameter of the proximal end of the roll support corresponds to the first inner diameter, so as to rotatably hold the roll of absorbent material.

6. The roll of absorbent material according to claim 1, wherein the mandrel has two roll support elements.

7. The roll of absorbent material according to claim 1, wherein the mandrel is made in one piece.

8. The roll of absorbent material according to claim 1, wherein the roll support element is wider at the proximal end than at the free distal end.

9. A system for a roll of absorbent sheet material, comprising:

a length of absorbent sheet material wound on a cylindrical core, the cylindrical core comprising openings of a first inner diameter at each end;

a core plug present in said cylindrical core at one end only, the core plug having a circular opening with a diameter substantially less than that of said first inner diameter, the core plug having a radially outwardly projecting flange having an outer diameter greater than said first inner diameter of the cylindrical core; and a support mandrel having a roll support element that is tapered from a proximal end to a free distal end of the roll support element, the cylindrical core configured to spin on at least the proximal end of the roll support element, the core plug and opening being configured to spin on the free distal end of the roll support element.

10. The roll of absorbent sheet material according to claim 9, wherein the length of absorbent sheet material is toilet paper, the cylindrical core is made of cardboard, the core plug is made of injection-molded plastic.

11. The roll of absorbent sheet material according to claim 9, wherein the core plug has a circular central opening.

12. The roll of absorbent material according to claim 9, wherein a diameter of the proximal end of the roll support corresponds to the first inner diameter, so as to rotatably hold the roll of absorbent material.

13. The roll of absorbent material according to claim 9, wherein the mandrel has two roll support elements.

14. The roll of absorbent material according to claim 9, wherein the mandrel is made in one piece.

15. The roll of absorbent material according to claim 9, wherein the roll support element is wider at the proximal end than at the free distal end.

16. A roll of absorbent sheet material mounted on a one-piece support mandrel, comprising:

a length of absorbent sheet wiping material wound on a cylindrical core, the cylindrical core comprising openings of a first inner diameter at each end;

a core plug present in said cylindrical core at one end only, the core plug having a circular central opening with a diameter substantially less than that of said first inner diameter, the core plug including a radially outwardly projecting flange having an outer diameter greater than the first inner diameter of the core, and the one-piece support mandrel having a roll support element that is tapered from a proximal end to a free distal end of the roll support element, the cylindrical core configured to spin on at least the proximal end of the roll support element, the core plug and opening being configured to spin on the free distal end of the roll support element.

17. The roll of absorbent sheet material according to claim 16, wherein the length of absorbent sheet material is toilet paper, the cylindrical core is made of cardboard, the core plug is made of injection-molded plastic.

18. The roll of absorbent sheet material according to claim 16, wherein the core plug has a circular central opening.

19. The roll of absorbent material according to claim 16, wherein a diameter of the proximal end of the roll support corresponds to the first inner diameter, so as to rotatably hold the roll of absorbent material.

20. The roll of absorbent material according to claim 16, wherein the one-piece support mandrel has two roll support elements.

* * * * *